US006177871B1

(12) United States Patent
Rasband

(10) Patent No.: US 6,177,871 B1
(45) Date of Patent: Jan. 23, 2001

(54) RF-EAS TAG WITH RESONANCE FREQUENCY TUNING

(75) Inventor: Paul B. Rasband, Frederick, MD (US)

(73) Assignee: Westvaco Corporation, New York, NY (US)

( * ) Notice: Under 35 U.S.C. 154(b), the term of this patent shall be extended for 0 days.

(21) Appl. No.: 09/362,614

(22) Filed: Jul. 28, 1999

(51) Int. Cl.[7] ..... G08B 13/14

(52) U.S. Cl. ..... 340/572.5; 340/572.1; 340/572.8

(58) Field of Search ..... 340/568.1, 571, 340/572.1, 572.2, 572.3, 572.5, 572.7, 572.8, 825.34, 825.54; 29/25.01, 25.02, 25.03, 25.42

(56) References Cited

U.S. PATENT DOCUMENTS

| | | | | |
|---|---|---|---|---|
| 3,913,219 | * | 10/1975 | Lichtblau | 340/572.5 |
| 3,921,167 | * | 11/1975 | Fox | 307/116 |
| 4,583,099 | | 4/1986 | Reilly et al. | 343/895 |
| 4,835,524 | | 5/1989 | Lamond et al. | 340/572.3 |
| 4,985,288 | * | 1/1991 | Matsumoto et al. | 428/41.1 |
| 5,182,544 | * | 1/1993 | Aquilera et al. | 340/572.5 |
| 5,442,334 | | 8/1995 | Gallo et al. | 340/572.3 |
| 5,574,431 | | 11/1996 | McKeown | 340/572.3 |
| 5,645,932 | * | 7/1997 | Uchibori | 340/572.1 |
| 5,754,110 | * | 5/1998 | Appalucci et al. | 340/572.5 |
| 5,781,110 | | 7/1998 | Habeger, Jr. et al. | 340/572.5 |

* cited by examiner

*Primary Examiner*—Jeffery A. Hofsass
*Assistant Examiner*—Van T. Trieu
(74) *Attorney, Agent, or Firm*—Richard L. Schmalz; Deanna L. Baxam

(57) ABSTRACT

The present invention relates to a method for producing paperboard packaging (trays, lids, cartons, containers or combinations) with an integral RF-EAS security tag and a procedure for tuning the resonance frequency of the tag.

5 Claims, 2 Drawing Sheets

RF-EAS TAG WITH RESONANCE FREQUENCY TUNING

BACKGROUND OF INVENTION

The present invention relates generally to a method for producing packages with integral security tags of the RF-EAS type. More particularly, the invention relates to such a method whereby the security tags are applied to a web of packaging material that is converted into packaging blanks (e.g., trays, lids, cartons, containers or the like) on a printing press in a single pass operation, at substantially the same time that sales graphics are printed on the blanks. In addition, the present invention includes a procedure for precisely tuning the resonance frequency of the tags by adjusting print register for optimum performance in the field.

RF-EAS (Electronic Article Surveillance) tags are passive circuits with a resonance frequency tuned to the frequency of tag detectors located at the entrances and exits of retail establishments. When an active tag passes through a detector, an alarm sounds, alerting store employees to the potential theft of the tagged merchandise. State of the art RF-EAS tags are generally produced by a number of steps which include stamping, masking, photochemical treatments, chemical etching and printing. However, the tags currently available are too expensive to be economically used on items retailing for about $5.00 or less. The use of currently available tags entails not only the cost of the tag itself, but the cost of application of the tag to the product or its package, either on a packaging line, in a warehouse, or in the retailer's stockroom. Examples of such prior art tags are disclosed for example in U.S. Pat. Nos. 4,583,099; 4,835,524; 5,442,334; and, 5,574,431. As disclosed in these patents, such tags are generally prepared by applying patterned paths of conductive material on both face surfaces of a substrate, e.g., an inductor element (L) and capacitor element (C) on opposite sides of a suitable dielectric substrate.

It has also been suggested, as shown for example in U.S. Pat. No. 5,781,110, to form such tags on one side of a substrate utilizing a combination laminating printing procedure. However, these devices have been found to be inadequate in use because they do not resonate sharply enough to be detected by conventional and widely distributed detectors. Moreover, no means is provided for controlling the resonance frequency of such tags. Thus there remains a need in the art to provide a reliable and tunable security tag at reduced costs. The present invention fulfills that need by providing an RF-EAS tag that can be applied directly to the package component during the manufacturing process, eliminating the need for separate application, and which can be precisely tuned for controlling the resonance frequency.

SUMMARY OF INVENTION

The present invention relates generally to the production of RF-EAS security tags. More particularly, the invention relates to a method for applying such tags directly to the packaging material used to make packages for products to be protected by the tags.

A preferred embodiment of the invention combines a die-stamped metal foil or hot-stamped metallized film inductor which includes a lower capacitor plate applied to one surface of a paperboard substrate. A dielectric layer and upper capacitor plate are printed over the inductor component. The process of applying the inductor and printing the dielectric layer and upper capacitor plate is carried out at high speed, preferably on a web of paperboard at substantially the same time that sales graphics are printed on the paperboard to identify the product to be packaged. The tag may be located on the exterior surface of the paperboard or on the interior surface of the paperboard. By integrating the tag with the package economies of application are achieved since the cost of a separate tag application step is eliminated.

Another unique feature of the present invention is the circuit tuning made possible by the design of the top capacitor plate and its application method. Since this step is preferably carried out on a printing press, changing the print register during printing of the top capacitor plate permits changes in the capacitance of the circuit to adjust and fine tune its frequency for the various detectors involved.

The present invention can be implemented in the production of RF-EAS security tagged packages in a wide variety of forms (e.g. on packaging such as trays, lids, cartons, containers or the like) for a wide variety of goods. Meanwhile, the frequency tuning approach described herein can also be used in the production of individual RF-EAS security tags, e.g., tags which are subsequently attached to products or packaging via adhesive labels or the like.

DETAILED DESCRIPTION

Packages including security tags according to the present invention are employed in connection with an electronic article security system (not shown), particularly an electronic article security system of the radio frequency or RF type. Such security systems are well known in the art and, therefore, a complete description of the structure and operation of such a security system is not necessary for an understanding of the present invention. Suffice it to say that such electronic article security systems establish a surveillance area or zone, generally proximate to an entrance or exit of a facility, such as a retail establishment. The function of the security system is to detect the presence within the surveillance zone of an article having an active security tag attached thereto or attached to the corresponding packaging.

In the case of the present invention, the security tag includes components, hereinafter described in greater detail, which establish a resonant circuit that resonates when exposed to electromagnetic energy at or near a predetermined detection resonant frequency. A typical electronic article security system employing the tags of the present invention includes means for transmitting into or through the surveillance zone electromagnetic energy at or near the resonant frequency of the security tag, and means for detecting a field disturbance that the presence of an active security tag resonating circuit causes to establish the presence of a security tag, and thus a protected article, within the surveillance zone.

In a preferred embodiment, the security tag is applied directly to packaging for the protected article at the same time that sales graphics or the like are applied to the packaging on a printing press. Alternatively, the different components of the tag may be applied to the packaging material in separate steps using readily available conventional equipment. A preferred packaging material is coated one side (C1S) or coated two sides (C2S) paperboard. However, other substrates having a suitable dielectric nature may be employed, for example plastics such as polyester, polyethylene, polypropylene, polyamide or the like, and cloth, textiles or the like, including laminates of such materials with paper or paperboard.

Figure 1:
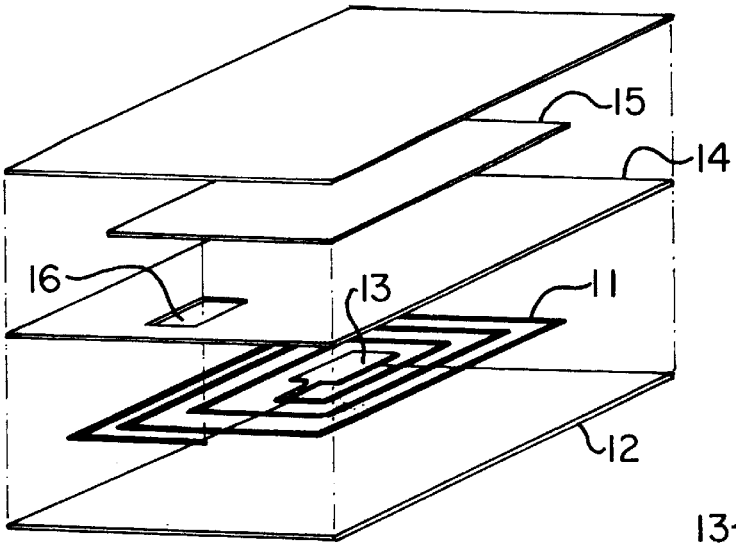
FIG. 1 shows an exploded view of the different elements used to make the RF-EAS tags of the present invention.

Referring to FIG. 1, the RF-EAS tag of the present invention is applied directly to the paper, paper-board or plastic substrate by a process which involves first applying an inductor element (11) onto the surface of the substrate 12, and then printing a capacitor element (15) over the inductor. The preferred inductor 11 is a metal foil element which is die-stamped or hot-stamped on the upper face of the substrate 12, although other methods capable of being applied at high speed in a continuous manner could be used such as laminating and etching or printing. Inductor element 11 includes a lower capacitor plate 13. Next, a low-loss polymer coating 14 prepared from polystyrene, polyethylene or the like is applied over the inductor 11 as an emulsion dispersed in a suitable binder. The application of the polymer coating 14 is made by printing or coating using conventional equipment. Subsequently, a top capacitor plate 15 is applied over the polymer coating preferably by printing with a conductive ink. Means is provided in the form of an opening 16 in polymer coating 14 to permit contact between the lower capacitor plate 13 of inductor 11 and top capacitor plate 15 to form a resonant circuit.

Each of the above-identified steps are preferably carried out in a single pass on suitable printing/coating equipment at the same time that sales graphics are printed on the substrate. The result is packaging blanks that can be converted into trays, lids, cartons, containers or the like which include integral RF-EAS tag components for security protection. For use in packaging products where high visibility is desired for the security tag, the tag may be applied to the exterior of the packaging material. Where a more covert application of the tag is desired, the tags may be applied to the interior of the packaging material.

Figure 4:
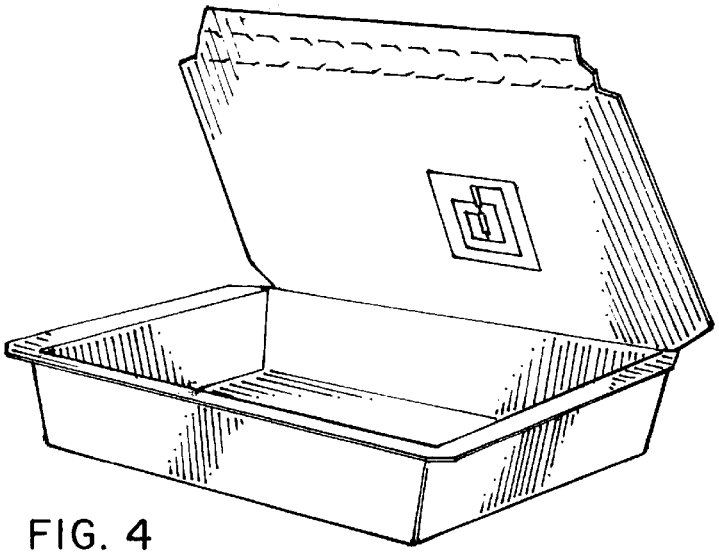
FIG. 4 shows a typical application of the RF-EAS tag of the present invention on a paperboard container and, FIG. 5 illustrates schematicallly an example of a method for carrying out the invention.
Figure 5:
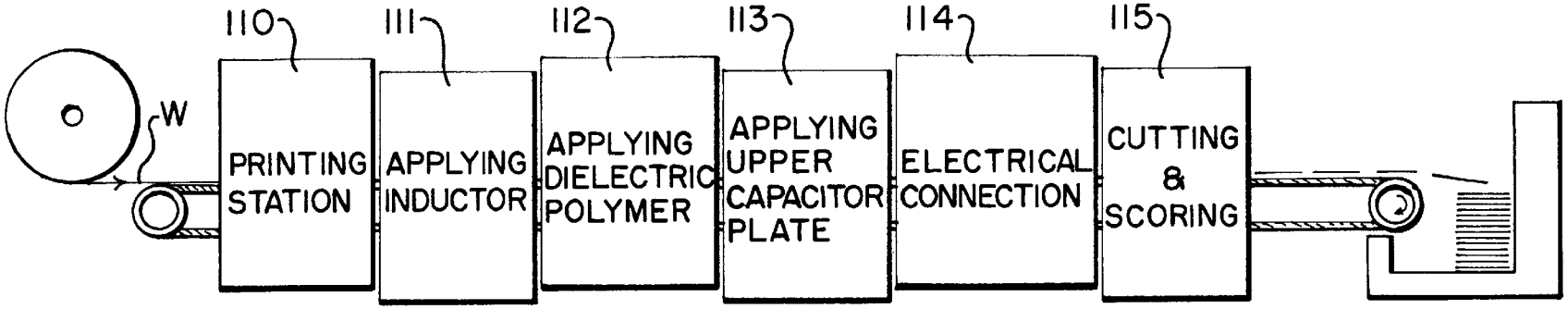

FIG. 5 shows schematically an example of the steps that may be taken to carry out the present invention. In a preferred embodiment, a web of packaging material W is first printed on one side at printing station 10 with graphics suitable for the intended packaging application. Next, integral RF-EAS security tags are applied directly to the web W in locations that coincide with the separate packaging blanks in accordance with the following steps. First, an inductor element including a lower capacitor plate is applied to the web W at station 11. Next, a dielectric polymer layer is applied to the web at station 12 over the inductor element. Thereafter, an upper capacitor plate is applied to the web W at station 13 on the surface of the polymer layer so as to lie directly over the inductor element. An opening means is provided in the polymer layer at station 14 to permit an electrical connection between the two capacitor plates, and the web W is cut into separate packaging blanks at station 15. Thereafter the blanks are stacked, packaged and shipped to a user who converts the blanks into packages, an example of which is shown in FIG. 4.

Figure 3:
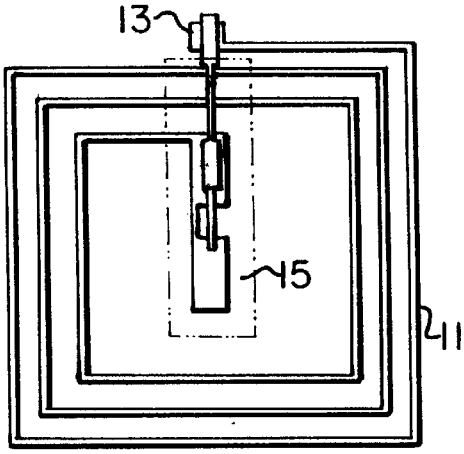
FIG. 3 is a plan view of the tag of the present invention showing the location of the capacitor plates to achieve minimum capacitance.

In accordance with the present invention, the tag resonance frequency can be tuned on press by varying the overlap of the top capacitor plate 15 with respect to the lower capacitor plate 13. As shown in FIG. 3, the top capacitor plate 15 has a minimum overlap of the lower capacitor plate 13 at the extreme top end. In this configuration, the total area of the capacitor is at a minimum which gives a relatively high resonance frequency to the tag.

Figure 2:
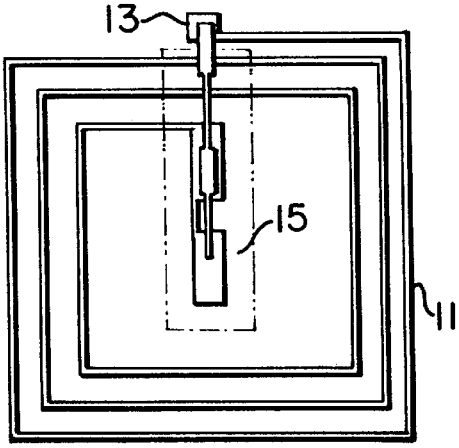
FIG. 2 is a plan view of the tag of the present invention showing the relationship of the upper and lower capacitor plates to produce maximum capacitance.

In FIG. 2, the printing register is shifted to yield maximum overlap of the top and bottom capacitor plates 15, 13. In this position, the capacitance is increased and the frequency is reduced. Preferably, the extreme end of the top capacitor plate 15 is made long and thin so that only small changes in the capacitance are produced with significant changes in the print registry. This provides high sensitivity to the tuning of the tag.

From the foregoing description, it will be seen that the present invention comprises an economical and expeditious method for applying RF-EAS security tags to packaging material. It will also be seen that the present invention provides a novel and unique procedure for tuning the resonant frequency of such tags. Nevertheless, it will be recognized by those skilled in the art that changes may be made to the invention as described without departing from the broad concepts thereof. Therefore, it is to be understood that the invention is not limited to the particular embodiments disclosed, and is intended to cover any modifications which fall within the scope and spirit of the appended claims.

What is claimed is:

1. A single pass method for producing packaging blanks with integral RF-EAS security tags applied directly to the packaging blanks comprising:

(a) selecting a web of packaging material having an outer surface and an inner surface;

(b) printing sales graphics substantially over the outer surface of said packaging material corresponding to the packaging blanks;

(c) forming directly on either the inner or outer surface of said packaging material an integral RF-EAS security tag having inductor/capacitor elements tuned to resonate at a specified frequency when exposed to electromagnetic energy by applying the inductor/capacitor tag elements directly on said packaging material in the region of the packaging-blanks in the following order:

(1) applying an inductor element including a lower capacitor plate directly to the surface of said packaging material;

(2) applying a dielectric polymer layer in the form of a to coating to the surface of said packaging material over said inductor element;

(3) applying an upper capacitor plate onto the surface of said packaging material by printing on said polymer layer so as to lie directly over said inductor element;

(4) providing means in the form of an opening through said polymer layer to permit an electrical connection between said lower capacitor plate and said upper capacitor plate to complete an electrical circuit; and, (5) cutting and scoring said packaging material to produce packaging blanks each with an integral RF-EAS tag.

2. The method of claim 1 wherein the web of packaging material is paperboard.

3. The method of claim 2 wherein the inductor element is a die-stamped foil inductor or a hot-stamped metallized film.

4. The method of claim 3 wherein the upper capacity plate is printed with a conductive ink.

5. The method of claim 4 wherein the resonance frequency of the security tag is varied by shifting the print registry of the upper capacitor plate with respect to the lower capacitor plate.

* * * * *